US008312751B2

(12) United States Patent
Suwabe et al.

(10) Patent No.: US 8,312,751 B2
(45) Date of Patent: Nov. 20, 2012

(54) METHOD FOR PRODUCING HIGH ALLOY PIPE

(75) Inventors: Hitoshi Suwabe, Itami (JP); Toshihide Ono, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 13/153,567

(22) Filed: Jun. 6, 2011

(65) Prior Publication Data

US 2011/0252854 A1 Oct. 20, 2011

Related U.S. Application Data

(63) Continuation of application No. PCT/JP2009/068954, filed on Nov. 6, 2009.

(30) Foreign Application Priority Data

Dec. 18, 2008 (JP) ..... 2008-321809
Jan. 19, 2009 (JP) ..... 2009-008406

(51) Int. Cl.
*B21B 17/00* (2006.01)
*B21B 23/00* (2006.01)

(52) U.S. Cl. ..... 72/208; 72/365.2

(58) Field of Classification Search ..... 72/208, 72/209, 283, 97, 365.2; 148/590–594, 605–611, 148/707, 909, 506, 519
See application file for complete search history.

(56) References Cited

U.S. PATENT DOCUMENTS

| | | | | |
|---|---|---|---|---|
| 4,421,571 | A | 12/1983 | Kudo et al. | |
| 4,489,040 | A * | 12/1984 | Asphahani et al. | 148/442 |
| 7,866,199 | B2 * | 1/2011 | Hirase et al. | 72/365.2 |
| 2010/0170320 | A1 * | 7/2010 | Sagara et al. | 72/368 |

FOREIGN PATENT DOCUMENTS

| | | |
|---|---|---|
| JP | 58-006927 | 1/1983 |
| JP | 58-009922 | 1/1983 |
| JP | 58-011735 | 1/1983 |
| JP | 58-181842 | 10/1983 |
| JP | 63-083248 | 4/1988 |
| JP | 63-203722 | 8/1988 |
| JP | 63-274743 | 11/1988 |
| JP | 11-302801 | 11/1999 |
| WO | 2009/014000 | 1/2009 |

* cited by examiner

*Primary Examiner* — Dana Ross
*Assistant Examiner* — Pradeep C Battula
(74) *Attorney, Agent, or Firm* — Clark & Brody

(57) ABSTRACT

A method for producing a high alloy pipe having a minimum yield strength of 758.3 to 965.2 MPa, comprising: preparing a high alloy pipe having controlled amounts of C, Si, Mn, Ni, Cr, Mo, Cu, and N, the balance being Fe and impurities by a hot working or further by a solid-solution heat treatment; and then subsequently subjecting the high alloy pipe to a cold rolling. The cold rolling is performed such that the working ratio Rd, in terms of the reduction of area, in the final cold rolling step falls within a range of larger than 30% and equal to or less than 80%, and the following formula is satisfied: $Rd(\%)>(MYS-520)/3.1-(Cr+6\times Mo+300\times N)$ wherein Rd and MYS signify the working ratio (%) in terms of the reduction of area and the targeted yield strength (MPa), respectively, and Cr, Mo and N signify the mass % of the individual elements.

4 Claims, 2 Drawing Sheets

[Fig. 1]
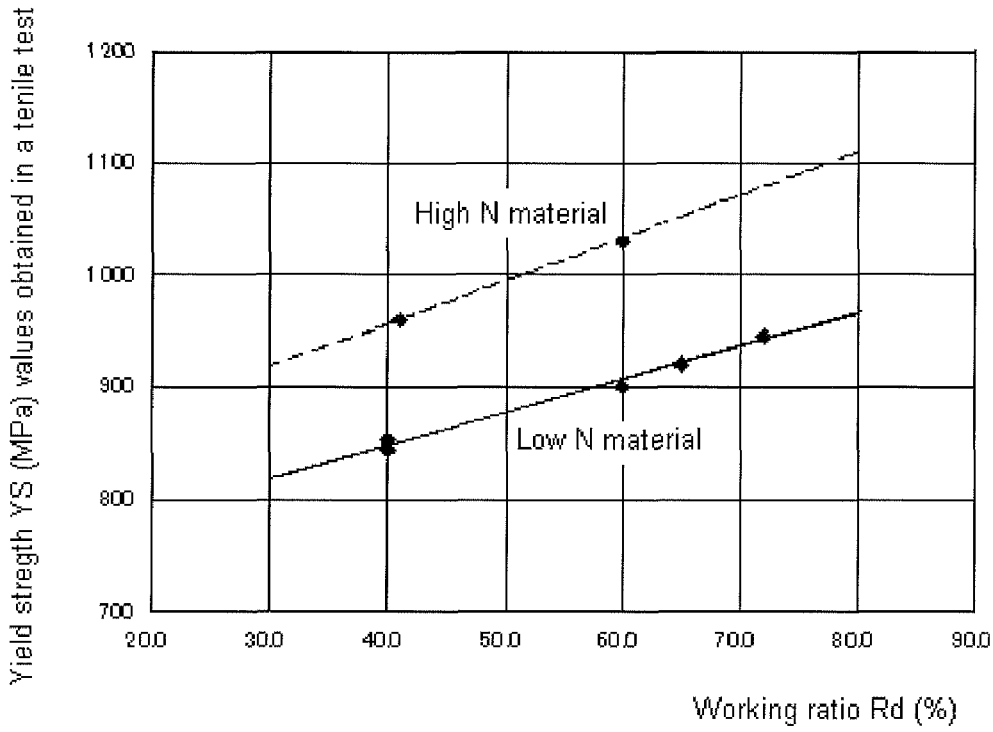

[Fig. 2]
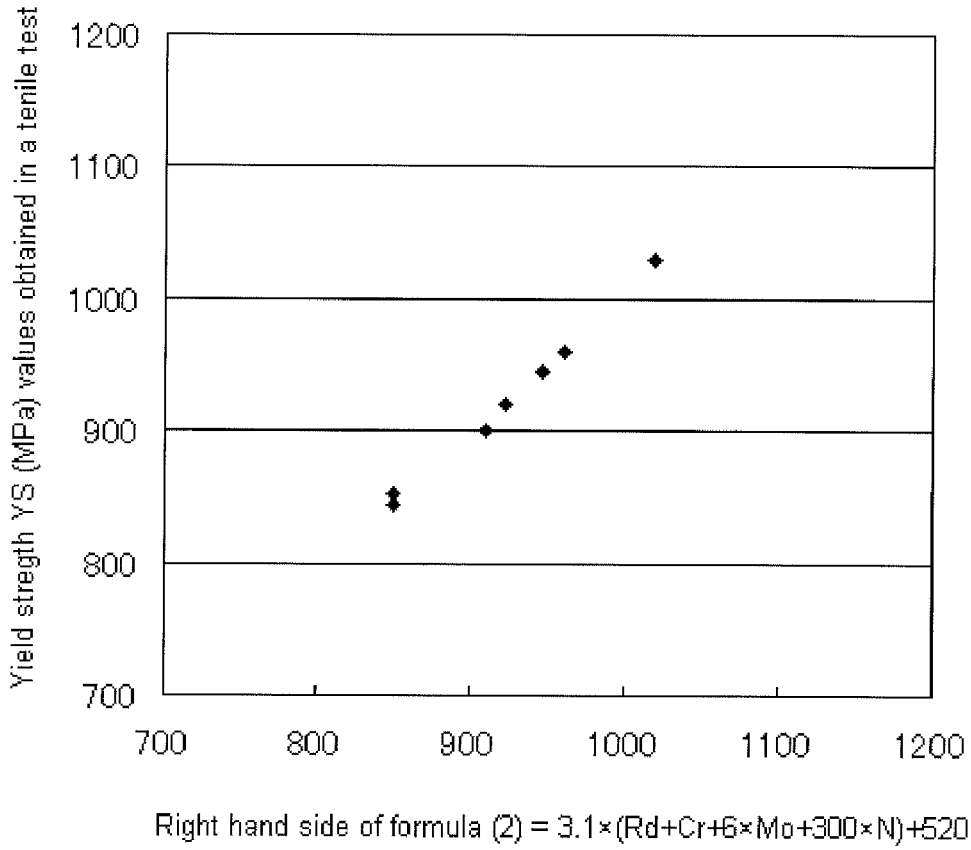

METHOD FOR PRODUCING HIGH ALLOY PIPE

TECHNICAL FIELD

The present invention relates to a method for producing a high alloy pipe that exhibits excellent corrosion resistance even in a carbon dioxide gas corrosive environment or in a stress corrosive environment, and at the same time has a high strength. The high alloy pipe produced according to the present invention can be used for, for example, oil wells or gas wells (hereinafter, collectively referred to as "oil wells").

BACKGROUND ART

In deep oil wells or oil wells in severe corrosive environments involving corrosive substances such as humid carbon dioxide gas ($CO_2$), hydrogen sulfide ($H_2S$) or chloride ion ($Cl^-$), high alloy pipes made of high Cr-high Ni alloys have hitherto been used. However, in these years, oil wells have a remarkable tendency toward being deeper, and hence, for the purpose of the use in environments more severe than those hitherto experienced, there have been required alloy pipes which are high in strength, in particular, of the grade of 110 to 140 ksi (the minimum yield strength is 758.3 to 965.2 MPa) and additionally have corrosion resistance.

Patent Documents 1 to 4 each disclose a method for producing a high alloy oil well pipe having a high strength by hot working and solution treatment of a high Cr-high Ni alloy, and then cold working with a reduction of wall thickness of 10 to 60%.

Patent Document 5 discloses that for the purpose of obtaining an austenite alloy excellent in the corrosion resistance in a hydrogen sulfide environment, a cold working is performed to the alloy that contains La, Al, Ca, S and O in a specified interrelation, so that the shapes of the inclusions are controlled. The cold working is performed for the purpose of adding strength, and from the viewpoint of corrosive resistance, a wall thickness reducing of 30% or less is performed.

Patent Document 6 discloses a high Cr-high Ni alloy improved in the stress corrosion cracking resistance in a hydrogen sulfide environment by specifying the contents of Cu and Mo, and states that the strength is preferably controlled by cold working of working ratio of 30% or less after hot working.

Patent Document 7 discloses a method for producing a high Ni alloy for use in oil well pipes, wherein the high Ni alloy is designed to contain an appropriate amount of N and to contain S in a content limited to 0.01% by weight or less, and is capable of producing an oil well pipe excellent in stress corrosion cracking resistance by being subjected to a solution heat treatment and by subsequently subjected to a cold working of 5 to 25%.

Patent Document 8 discloses a method for producing a sour gas resistant oil well pipe wherein the pipe is subjected to a plastic working by 35% or more in terms of the reduction of area in the temperature range from 200° C. to normal temperature, successively heated to a temperature immediately above the recrystallization temperature and held at this temperature and then cooled, and then subjected to a cold working, including a description of an example in which in the final cold working, a cold drawing of 15 to 30% was performed.

CITATION LIST

Patent Documents

[Patent Document 1] JP58-6927A
[Patent Document 2] JP58-9922A

[Patent Document 3] JP58-11735A
[Patent Document 4] U.S. Pat. No. 4,421,571B
[Patent Document 5] JP63-274743A
[Patent Document 6] JP11-302801A
[Patent Document 7] JP63-83248A
[Patent Document 8] JP63-203722A

SUMMARY OF INVENTION

Technical Problem

However, in the above-described documents, no specific investigation has been made on the high strength attained by the cold working wherein the composition of the high alloy pipe is taken into account, and no suggestion is offered with respect to the appropriate composition design or the cold working conditions for attaining the targeted strength, in particular, the targeted yield strength.

In view of these circumstances, an object of the present invention is to provide a method for producing a high alloy pipe which has not only a corrosion resistance required for the oil well pipes used in deep oil wells or in severe corrosive environments but at the same time has a targeted strength.

Solution to Problem

For the purpose of solving the above-described problems, the present inventors performed experiments on high alloy materials having various chemical compositions, for examining tensile strength by diversely varying the working ratio in the final cold rolling, in the production of high alloy pipes by cold rolling. Consequently, the present inventors obtained the following findings (a) to (h).

(a) The high alloy pipes used in deep oil wells or in oil wells used in severe corrosive environments are required to have corrosion resistance. When the basic chemical composition of the high alloy pipe is set such that has (20 to 30%) Cr-(25 to 40%) Ni, the content of C is required to be decreased from the viewpoint of corrosion resistance.

(b) When the content of C is reduced, the strength comes to be insufficient without applying any other operation; however, a high alloy material pipe formed by hot working or further by solid-solution heat treatment can be improved in strength by subsequently applying cold rolling. Here, it is to be noted that when the working ratio exceeds 80% in terms of the reduction of area, the high strength is maintained but the work hardening occurs, and hence the ductility or the toughness is deteriorated. When the working ratio in this case is 30% or less in terms of the reduction of area, no intended high strength can be attained. Consequently, it is necessary to set the working ratio of the cold rolling at more than 30% and 80% or less in terms of the reduction of area, and the working ratio is preferably 35 to 80%.

(c) Additionally, it has been found that when the working ratio Rd at the time of performing the cold rolling is in a range of more than 30% and 80% or less in terms of the reduction of area, in a high alloy pipe having a basic chemical composition of (20 to 30%) Cr-(25 to 40%) Ni, the larger is the working ratio Rd of the final cold rolling, the higher is the yield strength YS obtained, and the relation between the working ratio Rd and the yield strength YS is represented as a linear relationship.

It has also been found that the strength of the high alloy pipe is significantly affected by the content of N, and the higher is the content of N in the high alloy material, the higher-strength high alloy pipe can be obtained. This is probably because the larger is the content of N, the more extensively the solid-solution strengthening is developed, and thus the strength is improved.

FIG. 1 presents the plots of the yield strength YS (MPa) values obtained in a tensile test against the working ratio Rd(%) values in terms of the reduction of area, for the high alloy pipes having various chemical compositions, used in the below-described Example. FIG. 1 shows that there occurs a linear relationship between the working ratio Rd in terms of the reduction of area and the yield strength YS for each of a high N material (content of N: 0.1963% by mass) and a low N material (content of N: 0.0784 to 0.0831% by mass). FIG. 1 also shows that the higher yield strength YS values are obtained for the high N material than for low N material, and it is seen that with the increase of the content of N, a high alloy pipe having a higher strength can be obtained.

(d) Next, the present inventors have thought up that it comes to be possible to establish an appropriate component design technique to be associated with the pipe working conditions, for the purpose of attaining the yield strength targeted for the high alloy pipe, because the yield strength of the high alloy pipe is dependent on the working ratio Rd at the time of performing the cold rolling and the chemical composition of the high alloy pipe. In other words, for the purpose of attaining the yield strength targeted for the high alloy pipe, not the fine regulation based on the chemical composition of the high alloy pipe, but the fine regulation based on the working ratio Rd at the time of performing the cold rolling comes to be realizable. Additionally, it comes to be unnecessary to perform the melting of a large number of kinds of high alloys prepared by varying the alloy composition according to the demanded strength level, and consequently, the overstock of the material billets can be suppressed.

As described above, when the appropriate component design technique associated with the pipe working conditions can be established, it is only required to perform the cold rolling, for the purpose of obtaining a high alloy pipe having a targeted strength, under the cold rolling conditions targeted by taking account of the alloy composition of the stock, namely, with the targeted working ratio Rd or the higher working ratio than the targeted working ratio, without being required to vary the alloy composition of the stock on a case-by-case basis.

(e) On the basis of such an idea as described above, the present inventors have continuously made a diligent study on the correlations between the yield strength of the high alloy pipe, the working ratio Rd at the time of performing the cold rolling and the chemical composition of the high alloy pipe. Consequently, it has been found that in a high alloy pipe having the basic chemical composition of (20 to 30%) Cr-(25 to 40%) Ni and the content of N falling within a range from 0.05 to 0.50%, when the working ratio Rd at the time of performing the cold rolling falls within a range of larger than 30% and equal to or less than 80% in terms of the reduction of area, the yield strength YS (MPa) can be calculated on the basis of the working ratio Rd determined by the reduction of area at the time of performing the cold rolling and the individual contents of Cr, Mo and N in the chemical composition of the high alloy pipe, and on the basis of the following formula (2):

$$YS=3.1\times(Rd+\mathrm{Cr}+6\times\mathrm{Mo}+300\times\mathrm{N})+520 \quad (2)$$

wherein YS and Rd signify the yield strength (MPa) and the working ratio (%) in terms of the reduction of area, respectively, and Cr, Mo and N signify the contents (mass %) of the respective elements.

In general, examples of the method of cold working include a cold drawing using a drawing machine with a die and a plug and a cold rolling using a pilger mill with roll-dies and a mandrel. However, the present inventors have found that even when the working ratios determined by the same reduction of area are concerned, the strength of the pipe obtained by cold drawing is higher than the strength of the pipe of the present invention obtained by cold rolling. Consequently, the present invention is restricted to a method for producing a high alloy pipe through a step of cold rolling.

FIG. 2 is a plot of the yield strength YS (MPa) values obtained by a tensile test against the values obtained by substituting, into the right side of the above-described formula (2), the chemical compositions and the working ratios Rd(%) in terms of the reduction of area, for the various high alloy pipes used in Example described below, wherein the abscissa represents the right side of formula (2) and the ordinate represents the YS. FIG. 2 shows that as far as the high alloy pipe having the basic chemical composition of (20 to 30%) Cr-(25 to 40%) Ni is concerned, the yield strength of the high alloy pipe can be obtained with a satisfactory accuracy, according to formula (2), from the chemical composition of the high alloy pipe and the working ratio Rd(%) in terms of the reduction of area for the high alloy pipe.

(f) Accordingly, for the purpose of obtaining a high alloy pipe having a targeted strength, it is only required to develop, by the cold rolling, the yield strength fraction exclusive of the yield strength developed by the alloying components of the stock, namely, by the contents of Cr, Mo and N. Thus, for the purpose of attaining the targeted yield strength MYS (grade of 110 to 140 ksi (the minimum yield strength is 758.3 to 965.2 MPa)), after the chemical composition of the high alloy pipe is selected so as to have the basic chemical composition of (20 to 30%) Cr-(25 to 40%) Ni and the content of N falling within a range from 0.05 to 0.50%, it is only required to perform the final cold rolling with the working ratio Rd(%) obtained from the above-described formula (2) or the working ratio larger than this working ratio. Consequently, it is only required to perform the cold rolling under the conditions that the working ratio Rd, in terms of the reduction of area in the final cold rolling step, falls within a range of larger than 30% and equal to or less than 80%, and additionally the following formula (1) is satisfied:

$$Rd(\%)\geqq(MYS-520)/3.1-(\mathrm{Cr}+6\times\mathrm{Mo}+300\times\mathrm{N}) \quad (1)$$

wherein Rd and MYS signify the working ratio (%) in terms of the reduction of area and the targeted yield strength (MPa), respectively, and Cr, Mo and N signify the contents (mass %) of the individual elements, respectively.

(g) It has also been found that for the purpose of obtaining a high alloy pipe having a higher strength, namely, a high alloy pipe having a targeted yield strength MYS (grade of 125 to 140 ksi (the minimum yield strength is 861.8 to 965.2 MPa)), it is only required to regulate the working ratio Rd in terms of the reduction of area in the final cold rolling step to fall particularly within a range from 60 to 80%, or to increase the content of N in the high alloy so as to fall particularly within a range from 0.16 to 0.50%. Accordingly, by restricting the working ratio Rd in terms of the reduction of area in the final cold rolling step to fall particularly within a range from 60 to 80%, it is possible to produce a high alloy pipe having the targeted yield strength MYS (grade of 125 to 140 ksi (the minimum yield strength is 861.8 to 965.2 MPa)), even with the content of N staying within a range from 0.05 to 0.50%. Alternatively, by increasing the content of N so as to fall particularly within a range from 0.16 to 0.50%, it is possible to produce a high alloy pipe having the targeted yield strength MYS (grade of 125 to 140 ksi (the minimum yield strength is 861.8 to 965.2 MPa)), even with the working ratio Rd in terms of the reduction of area in the final cold rolling step staying within a range of larger than 30% and equal to or less than 80%. Further, when the working ratio Rd in terms of the reduction of area in the final cold rolling step is specified to fall within a range from 60 to 80% and the content of N in the high alloy is increased so as to fall within a range from 0.16 to 0.50%, it is possible to produce a high alloy pipe in which the targeted yield strength is of a higher grade of 140 ksi (the minimum yield strength is 965.2 MPa).

(h) As described above, for the high alloy pipe having the basic chemical composition of (20 to 30%) Cr-(25 to 40%) Ni, without excessively adding the alloying components, by selecting the working conditions at the time of the cold rolling, the targeted yield strength can be attained, and hence the reduction of the raw material cost can be achieved. Further, by selecting the working conditions at the time of the cold rolling in conformity with the alloy composition of the stock, the high alloy pipe having the targeted strength can be obtained, and hence it comes to be unnecessary to perform the melting of a large number of kinds of high alloys by varying the alloy composition depending on the strength level; accordingly, the overstock of the material billets can be suppressed.

The present invention has been perfected on the basis of such new findings as described above, and the gist of the present invention is as described in the following items (1) to (4).

(1) A method for producing a high alloy pipe having a minimum yield strength of 758.3 to 965.2 MPa, comprising:

preparing a high alloy material pipe having a chemical composition consisting, by mass %, of C: 0.03% or less, Si: 1.0% or less, Mn: 0.3 to 5.0%, Ni: 25 to 40%, Cr: 20 to 30%, Mo: 0 to 4%, Cu: 0 to 3% and N: 0.05 to 0.50%, and the balance being Fe and impurities, by a hot working or further by a solid-solution heat treatment; and producing the high alloy pipe by subsequently subjecting the high alloy material pipe to a cold rolling, wherein the cold rolling is performed under the conditions that the working ratio Rd, in terms of the reduction of area, in the final cold rolling step falls within a range of larger than 30% and equal to or less than 80%, and the following formula (1) is satisfied:

$$Rd(\%) \geqq (MYS-520)/3.1-(Cr+6\times Mo+300\times N) \quad (1)$$

wherein Rd and MYS signify the working ratio (%) in terms of the reduction of area and the targeted yield strength (MPa), respectively, and Cr, Mo and N signify the contents (mass %) of the individual elements, respectively.

(2) A method for producing a high alloy pipe having a minimum yield strength of 861.8 to 965.2 MPa, comprising:

preparing a high alloy material pipe having a chemical composition consisting, by mass %, of C: 0.03% or less, Si: 1.0% or less, Mn: 0.3 to 5.0%, Ni: 25 to 40%, Cr: 20 to 30%, Mo: 0 to 4%, Cu: 0 to 3% and N: 0.05 to 0.50%, and the balance being Fe and impurities, by a hot working or further by a solid-solution heat treatment; and producing the high alloy pipe by subsequently subjecting the high alloy material pipe to a cold rolling, wherein the cold rolling is performed under the conditions that the working ratio Rd, in terms of the reduction of area, in the final cold rolling step falls within a range from 60 to 80%, and the following formula (1) is satisfied:

$$Rd(\%) \geqq (MYS-520)/3.1-(Cr+6\times Mo+300\times N) \quad (1)$$

wherein Rd and MYS signify the working ratio (%) in terms of the reduction of area and the targeted yield strength (MPa), respectively, and Cr, Mo and N signify the contents (mass %) of the individual elements, respectively.

(3) A method for producing a high alloy pipe having a minimum yield strength of 861.8 to 965.2 MPa, comprising:

preparing a high alloy material pipe having a chemical composition consisting, by mass %, of C: 0.03% or less, Si: 1.0% or less, Mn: 0.3 to 5.0%, Ni: 25 to 40%, Cr: 20 to 30%, Mo: 0 to 4%, Cu: 0 to 3% and N: 0.16 to 0.50%, and the balance being Fe and impurities, by a hot working or further by a solid-solution heat treatment; and producing the high alloy pipe by subsequently subjecting the high alloy material pipe to a cold rolling, wherein the cold rolling is performed under the conditions that the working ratio Rd, in terms of the reduction of area, in the final cold rolling step falls within a range of larger than 30% and equal to or less than 80%, and the following formula (1) is satisfied:

$$Rd(\%) \geqq (MYS-520)/3.1-(Cr+6\times Mo+300\times N) \quad (1)$$

wherein Rd and MYS signify the working ratio (%) in terms of the reduction of area and the targeted yield strength (MPa), respectively, and Cr, Mo and N signify the contents (mass %) of the individual elements, respectively.

(4) A method for producing a high alloy pipe having a minimum yield strength of 965.2 MPa, comprising:

preparing a high alloy material pipe having a chemical composition consisting, by mass %, of C: 0.03% or less, Si: 1.0% or less, Mn: 0.3 to 5.0%, Ni: 25 to 40%, Cr: 20 to 30%, Mo: 0 to 4%, Cu: 0 to 3% and N: 0.16 to 0.50%, and the balance being Fe and impurities, by a hot working or further by a solid-solution heat treatment; and producing the high alloy pipe by subsequently subjecting the high alloy material pipe to a cold rolling, wherein the cold rolling is performed under the conditions that the working ratio Rd, in terms of the reduction of area, in the final cold rolling step falls within a range from 60 to 80%, and the following formula (1) is satisfied:

$$Rd(\%) \geqq (MYS-520)/3.1-(Cr+6\times Mo+300\times N) \quad (1)$$

wherein Rd and MYS signify the working ratio (%) in terms of the reduction of area and the targeted yield strength (MPa), respectively, and Cr, Mo and N signify the contents (mass %) of the individual elements, respectively.

Advantageous Effects of Invention

According to the present invention, a high alloy pipe having the corrosion resistance required for oil well pipes used in deep oil wells or in severe corrosive environments and at the same time having a targeted strength can be produced without excessively adding alloying components, by selecting the working conditions at the time of the cold rolling.

BRIEF DESCRIPTION OF DRAWINGS

FIG. 1 is the plots, for high alloy pipes, of the yield strength YS (MPa) values obtained in a tensile test against the working ratio Rd(%) values in terms of the reduction of area.

FIG. 2 is a plot, for high alloy pipes, of the yield strength YS (MPa) values obtained by a tensile test against the values obtained by substituting, into the right side of the above-described formula (2), the chemical compositions and the working ratios Rd(%) in terms of the reduction of area, wherein the abscissa represents the right side of formula (2) and the ordinate represents the YS.

DESCRIPTION OF EMBODIMENTS

Next, description is made on the reasons for limiting the chemical composition of the high alloy used in the method for producing a high alloy pipe according to the present invention. Here, it is to be noted that "%" in each of the contents of the individual elements represents "mass %."

C: 0.03% or less

When the content of C exceeds 0.03%, the carbide of Cr is formed in the crystal grain boundary, and the stress corrosion cracking susceptibility in the grain boundary is increased. Consequently, the upper limit of the content of C is set at 0.03%. A preferable upper limit is 0.02%.

Si: 1.0% or less

Si is an element that is effective as a deoxidizer for alloys, and can be contained if necessary. The effects as the deoxidizer are obtained for the content of Si of 0.05% or more. However, when the content of Si exceeds 1.0%, the hot workability is deteriorated, and consequently, the content of Si is set at 1.0% or less. The range of the content of Si is preferably 0.5% or less, and more preferably 0.4% or less.

Mn: 0.3 to 5.0%

Mn is an element that is effective as a deoxidizer for alloys similarly to Si as described above, and is also effective for stabilization of the austenite phase. The effect of Mn is obtained with the content of Mn of 0.3% or more. However, when the content of Mn exceeds 5.0%, the hot workability is deteriorated. When the upper limit of the content of N effective for increasing the strength is set at as high as 0.5%, pin holes tend to occur in the vicinity the surface of the alloy at the time of solidification after melting, and hence it is preferable to contain Mn having an effect to increase the solubility of N, and consequently, the upper limit of the content of Mn is set at 5.0%. Consequently, the content of Mn is set at 0.3 to 5.0%. The range of the content of Mn is preferably from 0.3 to 3.0% and more preferably 0.4 to 1.0%.

Ni: 25 to 40%

Ni is an element that is important to stabilize the austenite phase and to maintain the corrosion resistance. However, when the content of Ni is less than 25%, no sufficient coating of Ni sulfide is produced on the outer surface of the alloy, and hence the effect due to the containing of Ni is not obtained. On the other hand, when Ni is contained in a content exceeding 40%, the effect due to Ni is saturated, the cost of the alloy is increased and the economic efficiency is impaired. Consequently, the content of Ni is set at 25 to 40%. The range of the content of Ni is preferably 29 to 37%.

Cr: 20 to 30%

Cr is a component that is effective in improving the hydrogen sulfide corrosion resistance typified by the stress corrosion cracking resistance in the concomitant presence of Ni, and in attaining a high strength through solid-solution strengthening. However, when the content of Cr is less than 20%, the effect of Cr is not obtained. On the other hand, when the content of Cr exceeds 30%, the effect due to Cr is saturated, and such high contents are not preferable from the viewpoint of the hot workability. Consequently, the content of Cr is set at 20 to 30%. The range of the content of Cr is preferably 23 to 27%.

Mo: 0 to 4% (inclusive of 0%)

Mo is a component that has the function of improving the stress corrosion cracking resistance in the concomitant presence of Ni and Cr, and is also effective in contributing to the improvement of the strength through solid-solution strengthening, and hence Mo can be contained if necessary. When it is intended to obtain the effect of Mo, Mo is preferably contained in a content of 0.01% or more. On the other hand, when the content of Mo is 4% or more, the effect of Mo is saturated, and the hot workability is deteriorated by excessively containing Mo. Consequently, the content of Mo is preferably set at 0.01 to 4%. For the purpose of obtaining an excellent stress corrosion cracking resistance, the lower limit of the content of Mo is preferably set at 1.5%.

Cu: 0 to 3% (inclusive of 0%)

Cu has a function to remarkably improve the hydrogen sulfide corrosion resistance in a hydrogen sulfide environment, and can be contained if necessary. When it is intended to obtain the effect of Cu, Cu is preferably contained in a content of 0.1% or more. However, when the content of Cu exceeds 3%, the effect of Cu is saturated, and adversely the hot workability is deteriorated. Consequently, when Cu is contained, the content of Cu is set preferably at 0.1 to 3% and more preferably at 0.5 to 2%.

N: 0.05 to 0.50%

The high alloy of the present invention is required to decrease the content of C from the viewpoint of the corrosion resistance. For that purpose, N is positively made to be contained, and the increase of the strength is attained through solid-solution strengthening, without deteriorating the corrosion resistance. By positively containing N, a high alloy pipe having a higher strength can be obtained after the solid-solution heat treatment. Accordingly, an intended strength can be acquired without excessively increasing the working ratio (reduction of area) at the time of performing the cold working, even with a low working ratio, and hence the ductility deterioration due to high working ratio can be suppressed. For the purpose of obtaining the effect of N, it is necessary to contain N in a content of 0.05% or more. On the other hand, when the content of N exceeds 0.50%, the hot workability is deteriorated, and moreover, pin holes tend to occur in the vicinity of the surface of the alloy at the time of solidification after melting. Consequently, the content of N is set at 0.05 to 0.50%. The range of the content of N is preferably 0.06 to 0.30% and more preferably 0.06 to 0.22%. When a higher strength is intended to be obtained, the lower limit of the content of N is preferably set at 0.16%.

Moreover, on the basis of the below-described reasons, P, S and O contained as the impurities are preferably limited in such a way that P: 0.03% or less, S: 0.03% or less and O: 0.010% or less.

P: 0.03% or less

P is contained as an impurity, and when the content of P exceeds 0.03%, the stress corrosion cracking susceptibility in a hydrogen sulfide environment is increased. Consequently, the upper limit of the content of P is preferably set at 0.03% or less and more preferably at 0.025%.

S: 0.03% or less

S is contained as an impurity, similarly to P as described above, and when the content of S exceeds 0.03%, the hot workability is remarkably deteriorated. Consequently, the upper limit of the content of S is preferably set at 0.03% and more preferably 0.005%.

O: 0.010% or less

In the present invention, N is contained in such a larger amount as 0.05 to 0.50%, and hence the hot workability tends to be deteriorated. When the content of 0 exceeds 0.010%, the hot workability is deteriorated. Consequently, the content of 0 is preferably set at 0.010% or less.

The high alloy according to the present invention may further contain one or more of Ca, Mg and the rare earth elements (REMs), in addition to the above-described alloying elements. The reasons why these elements may be contained and the contents of these elements when these elements are contained are as follows.

Ca: 0.01% or less, Mg: 0.01% or less and Rare Earth Element(s): 0.2% or less of one or more elements These components can be contained if necessary. When contained, any of these components fixes S that disturbs the hot workability, as a sulfide, and thus has an effect to improve the hot workability. However, when the content of either of Ca and Mg exceeds 0.01%, or the content of the REM(s) exceeds 0.2%, coarse oxides are produced, and the deterioration of the hot workability is caused; accordingly, the upper limits of these elements are set at 0.01% for Ca and Mg, and at 0.2% for the REM(s), respectively. It is to be noted that for the purpose of certainly developing the improving effect of the hot workability, it is preferable to contain Ca and Mg each in a content of 0.0005% or more and the REM(s) in a content of 0.001% or more. Herein, the REM is a generic name for the 17 elements which are the 15 lanthanoid elements and Y and Sc, and one or more of these elements can be contained. The content of REMs means the sum of the contents of these elements.

The high alloy pipe according to the present invention contains the above-described essential elements and additionally the above-described optional elements, the balance being composed of Fe and impurities. Here, the impurities as referred to herein mean the substances that contaminate high alloy materials when high alloy pipes are industrially produced, due to the raw materials such as ores and scraps, and due to various other factors in the production process, and are allowed to contaminate within the ranges not adversely affecting the present invention.

The high alloy pipe according to the present invention can be produced by the production equipment and the production method used for the usual commercial production. For example, for the melting of the alloy, there can be used an electric furnace, an Ar—$O_2$ mixed gas bottom blowing decarburization furnace (AOD furnace), a vacuum decarburization furnace (VOD furnace) or the like. The molten alloy obtained by melting may be cast into ingots, or may be cast into rod-like billets by a continuous casting method. By using these billets, with an extrusion pipe production method such as the Ugine-Sejournet process or with hot working such as the Mannesmann pipe making process, a high alloy material pipe for use in the cold rolling can be produced. The material pipe after the hot working can be converted into a product pipe having an intended strength by cold rolling.

In the present invention, the working ratio at the time of the final cold rolling is specified, the material pipe for use in the cold rolling, obtained by the hot working, is subjected to a solid-solution heat treatment if necessary, and subsequently the descaling for removing the scales on the pipe surface is performed, and thus a high alloy pipe having an intended strength may be produced by one run of cold rolling; or alternatively, before the final cold rolling, the solid-solution heat treatment is performed by conducting one or more runs of intermediate cold working, and the final cold rolling may be performed after descaling. In the present invention, the final cold working has only to be cold rolling, and the cold working performed intermediately may be either cold rolling or cold drawing. By performing an intermediate cold working, the working ratio in the final cold rolling is easily controlled, and at the same time, as compared to the case where the final cold rolling is applied in the state of having been subjected to hot working, a pipe having a higher-accuracy pipe dimension can be obtained by the final cold rolling.

Example 1

First, the alloys having the chemical compositions shown in Table 1 were melted with an electric furnace, and were regulated with respect to the components so as to have approximately the intended chemical compositions, and then, the melting was performed by a method in which by using an AOD furnace, a decarburization treatment and a desulfurization treatment were conducted. Each of the obtained molten alloys was cast into an ingot having a weight of 1500 kg and a diameter of 500 mm. Then, the ingot was cut to a length of 1000 mm to yield a billet for use in the extrusion pipe production. Next, by using this billet, a material pipe for use in the cold rolling was formed by the hot extrusion pipe production method based on the Ugine-Sejournet process.

TABLE 1

| | Chemical composition (mass %, the balance: Fe and impurities) | | | | | | | | | |
|---|---|---|---|---|---|---|---|---|---|---|
| Test No. | C | Si | Mn | P | S | Ni | Cr | Mo | Cu | N |
| 1 | 0.018 | 0.29 | 0.61 | 0.022 | 0.0003 | 30.27 | 24.79 | 2.79 | 0.81 | 0.0831 |
| 2 | 0.018 | 0.29 | 0.61 | 0.022 | 0.0003 | 30.27 | 24.79 | 2.79 | 0.81 | 0.0831 |
| 3 | 0.018 | 0.29 | 0.61 | 0.022 | 0.0003 | 30.27 | 24.79 | 2.79 | 0.81 | 0.0831 |
| 4 | 0.018 | 0.30 | 0.59 | 0.023 | 0.0002 | 30.23 | 24.76 | 2.77 | 0.79 | 0.0804 |
| 5 | 0.019 | 0.30 | 0.60 | 0.022 | 0.0002 | 30.35 | 24.69 | 2.79 | 0.74 | 0.0784 |
| 6 | 0.012 | 0.24 | 0.57 | 0.023 | 0.0002 | 30.71 | 25.26 | 2.83 | 0.78 | 0.1963 |
| 7 | 0.012 | 0.24 | 0.57 | 0.023 | 0.0002 | 30.71 | 25.26 | 2.83 | 0.78 | 0.1963 |

Each of the obtained material pipes for use in the cold working was subjected to a solution heat treatment under the conditions that water-cooling was performed after being held at 1100° C. for 2 minutes or more, then the final cold working based on the cold rolling using a pilger mill was performed by varying the working ratio (%) Rd in terms of the reduction of area so as to have different values as shown in Table 2, and thus a high alloy pipe was obtained. It is to be noted that before the cold rolling was performed, a shotblast was applied to the pipe, and thus the scales on the surface were removed. The dimensions (the outer diameter in mm×the wall thickness in mm) of each of the pipes before and after the final cold working are shown in Table 2. For some of the material pipes for use in the cold working, a solution heat treatment was performed in which, after a cold drawing, water-cooling was performed after being held at 1100° C. for 2 minutes or more, and then the final cold working based on cold rolling was performed.

TABLE 2

| Test No. | Dimensions before the final cold rolling (Outer diameter × inner diameter × wall thickness) | Dimensions after the final cold rolling (Outer diameter × inner diameter × wall thickness) | Rd (%) | Right side of Formula (2) (MPa) | Obtained value YS (MPa) | Obtained value TS (MPa) |
|---|---|---|---|---|---|---|
| 1 | 78 × 61.2 × 8.4 | 60.5 × 47.5 × 6.5 | 40 | 850.0 | 843.8 | 883.1 |
| 2 | 96 × 83 × 6.5 | 60.5 × 47.5 × 6.5 | 40 | 850.0 | 852.8 | 910.7 |
| 3 | 95 × 74.2 × 10.4 | 60.5 × 47.5 × 6.5 | 60 | 909.1 | 899.7 | 960.3 |
| 4 | 100 × 70 × 15 | 60.5 × 47.5 × 6.5 | 72 | 946.3 | 945.2 | 1000.3 |
| 5 | 101 × 79 × 11 | 60.5 × 47.6 × 6.45 | 65 | 922.8 | 919.7 | 970.0 |
| 6 | 97 × 80 × 8.5 | 60.5 × 43.5 × 8.5 | 41 | 960.6 | 960.3 | 1030.0 |
| 7 | 97 × 80 × 8.5 | 60.5 × 49.5 × 5.5 | 60 | 1019.5 | 1030.0 | 1129.9 |

Subsequently, from the obtained high alloy pipes, arc-shaped tensile test specimens in the pipe axis direction were sampled, and subjected to a tensile test. The observed values as the results of the test, namely, the yield strength YS (MPa) (0.2% yield stress) values and the tensile strength TS (MPa) values in the tensile test are shown in Table 2 together with the numerical values based on the right side of formula (2).

As shown in Table 2, by appropriately selecting the alloy composition and the working ratio Rd in terms of the reduction of area in the cold rolling step, a high alloy pipe having a high strength with a minimum yield strength of 758.3 to 965.2 MPa (grade of 110 to 140 ksi) as the targeted strength can be produced. Further, by setting the working ratio Rd particularly within a range from 60 to 80%, or by increasing the content of N particularly to be 0.16 to 0.50%, a high alloy pipe having a high strength with a minimum yield strength of 861.8 to 965.2 MPa (grade of 125 to 140 ksi) as the targeted strength can be produced. Moreover, by setting the working ratio Rd within a range from 60 to 80% and by increasing the content of N to be 0.16 to 0.50%, a high alloy pipe having a further higher strength with a minimum yield strength of 965.2 MPa (grade of 140 ksi) as the targeted strength can be produced.

INDUSTRIAL APPLICABILITY

The results are as described above, and hence, according to the present invention, a high alloy pipe that has not only a corrosion resistance that is required for the oil well pipes used in deep oil wells or in severe corrosive environments, but at the same time has a targeted strength can be produced, without excessively adding alloying components, by selecting the working conditions at the time of the cold rolling.

The invention claimed is:

1. A method for producing a high alloy pipe having a minimum yield strength of 758.3 to 965.2 MPa, comprising:

preparing a high alloy material pipe having a chemical composition consisting, by mass %, of C: 0.03% or less, Si: 1.0% or less, Mn: 0.3 to 5.0%, Ni: 25 to 40%, Cr: 20 to 30%, Mo: 0 to 4%, Cu: 0 to 3% and N: 0.05 to 0.50%, and the balance being Fe and impurities, by a hot working or further by a solid-solution heat treatment; and producing the high alloy pipe by subsequently subjecting the high alloy material pipe to a cold rolling, wherein the cold rolling is performed under the conditions that the working ratio Rd, in terms of the reduction of area, in the final cold rolling step falls within a range of larger than 30% and equal to or less than 80%, and the following formula (1) is satisfied:

$$Rd(\%) \geqq (MYS-520)/3.1-(Cr+6\times Mo+300\times N) \quad (1)$$

wherein Rd and MYS signify the working ratio (%) in terms of the reduction of area and the targeted yield strength (MPa), respectively, and Cr, Mo and N signify the contents (mass %) of the individual elements, respectively.

2. A method for producing a high alloy pipe having a minimum yield strength of 861.8 to 965.2 MPa, comprising:

preparing a high alloy material pipe having a chemical composition consisting, by mass %, of C: 0.03% or less, Si: 1.0% or less, Mn: 0.3 to 5.0%, Ni: 25 to 40%, Cr: 20 to 30%, Mo: 0 to 4%, Cu: 0 to 3% and N: 0.05 to 0.50%, and the balance being Fe and impurities, by a hot working or further by a solid-solution heat treatment; and producing the high alloy pipe by subsequently subjecting the high alloy material pipe to a cold rolling, wherein the cold rolling is performed under the conditions that the working ratio Rd, in terms of the reduction of area, in the final cold rolling step falls within a range from 60 to 80%, and the following formula (1) is satisfied:

$$Rd(\%) \geqq (MYS-520)/3.1-(Cr+6\times Mo+300\times N) \quad (1)$$

wherein Rd and MYS signify the working ratio (%) in terms of the reduction of area and the targeted yield strength (MPa), respectively, and Cr, Mo and N signify the contents (mass %) of the individual elements, respectively.

3. A method for producing a high alloy pipe having a minimum yield strength of 861.8 to 965.2 MPa, comprising:

preparing a high alloy material pipe having a chemical composition consisting, by mass %, of C: 0.03% or less, Si: 1.0% or less, Mn: 0.3 to 5.0%, Ni: 25 to 40%, Cr: 20 to 30%, Mo: 0 to 4%, Cu: 0 to 3% and N: 0.16 to 0.50%, and the balance being Fe and impurities, by a hot working or further by a solid-solution heat treatment; and producing the high alloy pipe by subsequently subjecting the high alloy material pipe to a cold rolling, wherein the cold rolling is performed under the conditions that the working ratio Rd, in terms of the reduction of area, in the final cold rolling step falls within a range of larger than 30% and equal to or less than 80%, and the following formula (1) is satisfied:

$$Rd(\%) \geqq (MYS-520)/3.1-(Cr+6\times Mo+300\times N) \quad (1)$$

wherein Rd and MYS signify the working ratio (%) in terms of the reduction of area and the targeted yield strength (MPa), respectively, and Cr, Mo and N signify the contents (mass %) of the individual elements, respectively.

4. A method for producing a high alloy pipe having a minimum yield strength of 965.2 MPa, comprising:

preparing a high alloy material pipe having a chemical composition consisting, by mass %, of C: 0.03% or less, Si: 1.0% or less, Mn: 0.3 to 5.0%, Ni: 25 to 40%, Cr: 20 to 30%, Mo: 0 to 4%, Cu: 0 to 3% and N: 0.16 to 0.50%, and the balance being Fe and impurities, by a hot working or further by a solid-solution heat treatment; and producing the high alloy pipe by subsequently subjecting the high alloy material pipe to a cold rolling, wherein the cold rolling is performed under the conditions that the working ratio Rd, in terms of the reduction of area, in the final cold rolling step falls within a range from 60 to 80%, and the following formula (1) is satisfied:

$$Rd(\%) \geqq (MYS-520)/3.1-(Cr+6\times Mo+300\times N) \quad (1)$$

wherein Rd and MYS signify the working ratio (%) in terms of the reduction of area and the targeted yield strength (MPa), respectively, and Cr, Mo and N signify the contents (mass %) of the individual elements, respectively.

* * * * *